US010418219B2

(12) United States Patent
Duan et al.

(10) Patent No.: US 10,418,219 B2
(45) Date of Patent: Sep. 17, 2019

(54) LEFT-HANDED MATERIAL EXTENDED INTERACTION KLYSTRON

(71) Applicant: University of Electronic Science and Technology of China, Chengdu, Sichuan (CN)

(72) Inventors: Zhaoyun Duan, Sichuan (CN); Xin Wang, Sichuan (CN); Xirui Zhan, Sichuan (CN); Fei Wang, Sichuan (CN); Shifeng Li, Sichuan (CN); Zhanliang Wang, Sichuan (CN); Yubin Gong, Sichuan (CN)

(73) Assignee: University of Electronic Science and Technology of China, Chengdu, Sichuan (CN)

( * ) Notice: Subject to any disclaimer, the term of this patent is extended or adjusted under 35 U.S.C. 154(b) by 0 days.

(21) Appl. No.: 16/131,028

(22) Filed: Nov. 13, 2018

(65) Prior Publication Data

US 2019/0057831 A1 Feb. 21, 2019

(30) Foreign Application Priority Data

Apr. 8, 2018 (CN) ..... 2018 10 306451

(51) Int. Cl.

| | |
|---|---|
| ***H01J 25/12*** | (2006.01) |
| ***H01J 23/22*** | (2006.01) |
| ***H01J 23/20*** | (2006.01) |

(52) U.S. Cl.
CPC ..... *H01J 25/12* (2013.01); *H01J 23/20* (2013.01); *H01J 23/22* (2013.01)

(58) Field of Classification Search
CPC .. H01J 25/10; H01J 25/11; H01J 25/12; H01J 25/34; H01J 23/11; H01J 23/16; H01J 23/20; H01J 23/22; H01P 1/208; H02J 50/20
See application file for complete search history.

(56) References Cited

U.S. PATENT DOCUMENTS

| | | | | |
|---|---|---|---|---|
| 8,441,191 | B2 * | 5/2013 | Protz | H01J 25/10 315/5.39 |
| 9,583,301 | B2 * | 2/2017 | Duan | H01J 23/16 |
| 9,741,521 | B1 * | 8/2017 | Perkins | H01J 23/20 |

* cited by examiner

*Primary Examiner* — Haissa Philogene

(57) ABSTRACT

A left-handed material extended interaction klystron includes: an input cavity, a middle cavity, an output cavity, first-section drift tube and a second-section drift tube; wherein the input cavity, the middle cavity and the output cavity are all cylindrical resonant cavities having arrays of Complementary electric Split-Ring Resonator (CeSRR) unit cells provided therein; wherein a first side of the input cavity is an input channel of an electron beam, a second side connects the middle cavity via the first-section drift tube; a first T-shaped coaxial input structure is provided in the input cavity; a first side of the output cavity is for connecting a collector, a second side of the output cavity connects the middle cavity via the second-section drift tube, a second T-shaped coaxial output structure is provided in the output cavity.

9 Claims, 7 Drawing Sheets

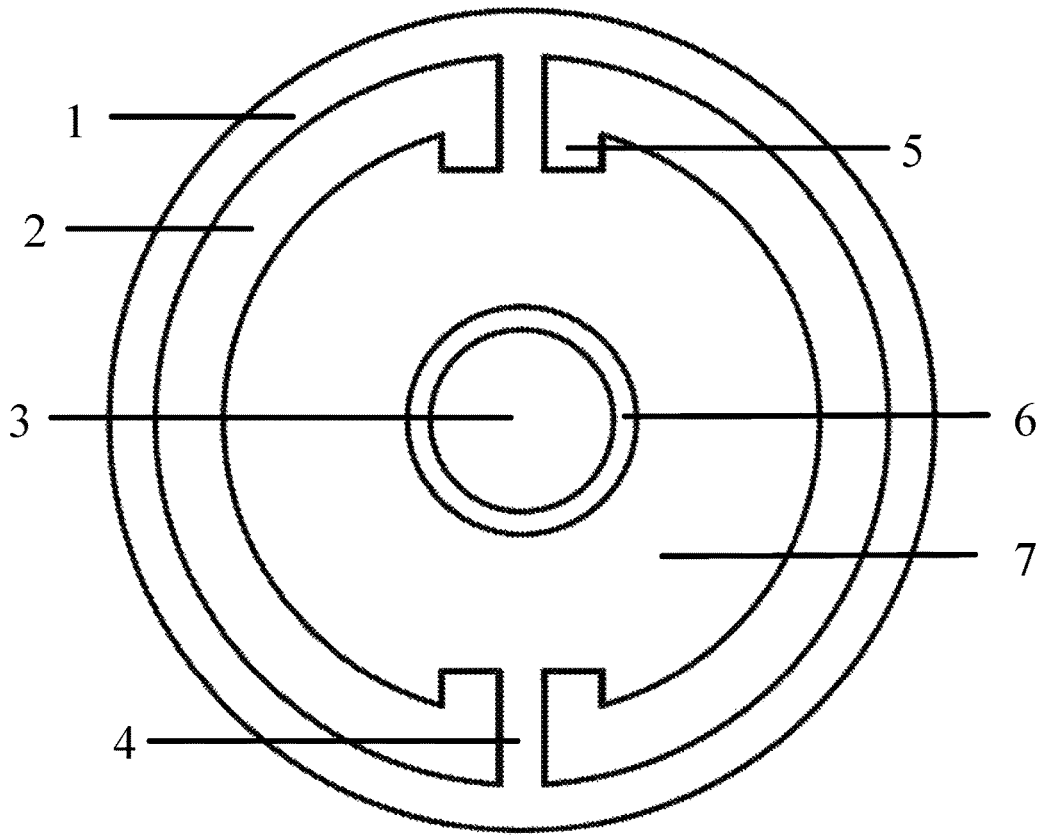
Fig. 1-a

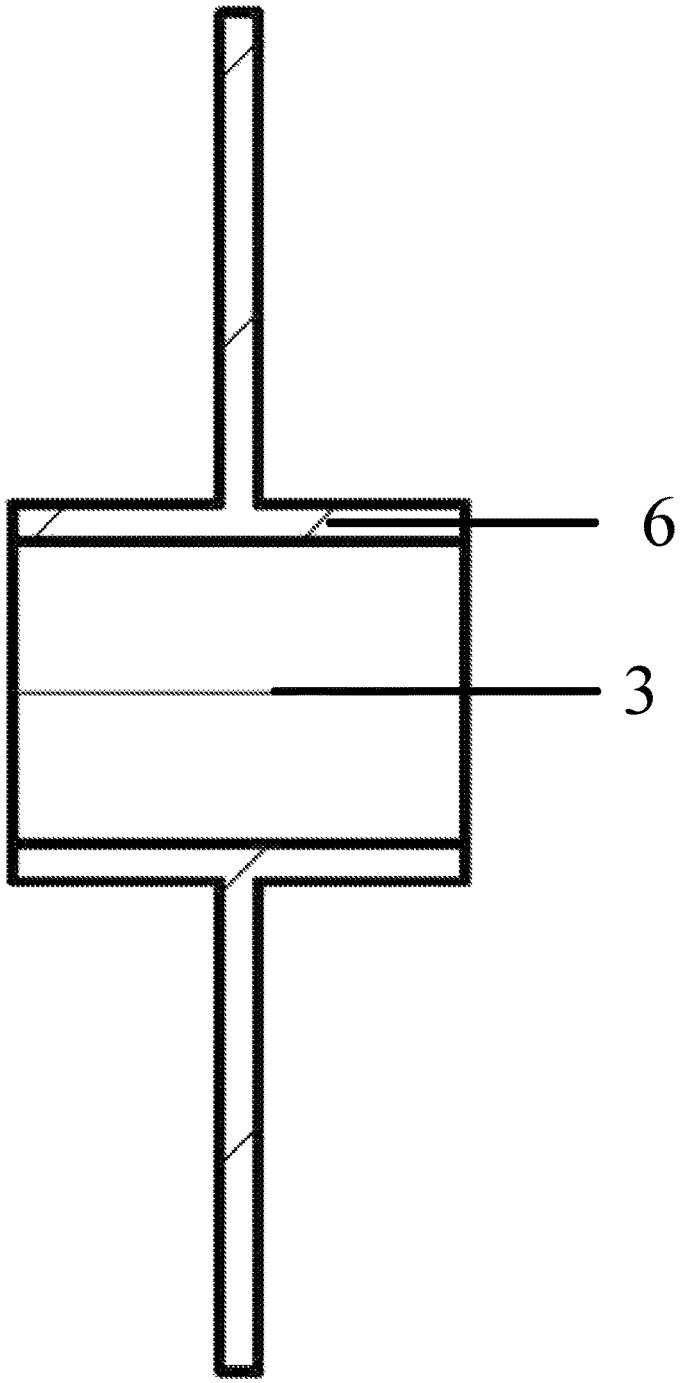
Fig. 1-b

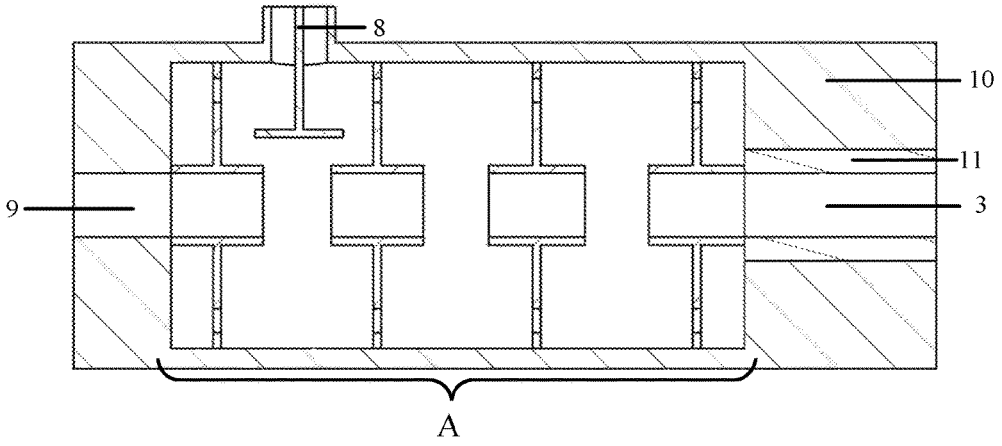
Fig. 1-c

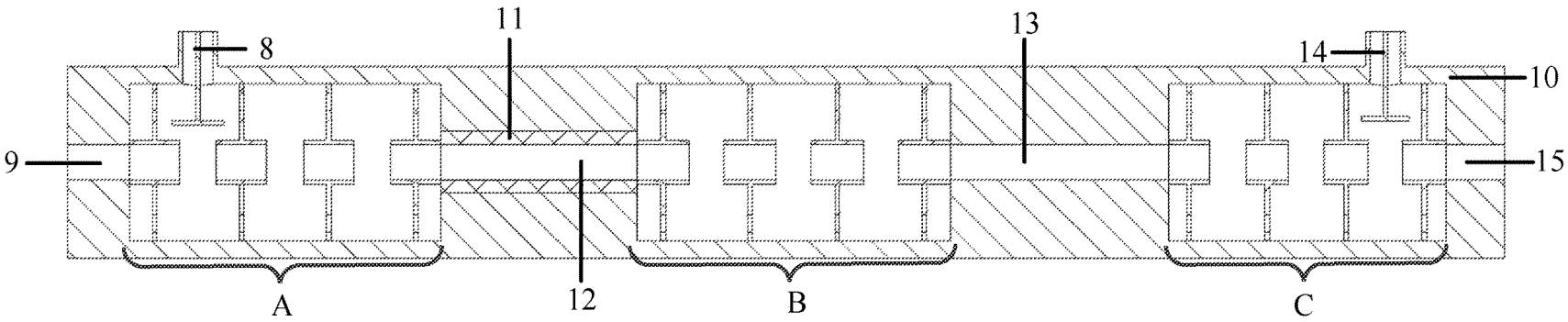
Fig. 1-d

LEFT-HANDED MATERIAL EXTENDED INTERACTION KLYSTRON

CROSS REFERENCE OF RELATED APPLICATION

The present application claims priority under 35 U.S.C. 119(a-d) to CN 201810306451.6, filed Apr. 8, 2018.

BACKGROUND OF THE PRESENT INVENTION

Field of Invention

The present invention relates to the technical field of microwave vacuum electronic devices, and more particularly to left-handed materials, extended interaction klystron (EIK) amplifier, and extended interaction oscillator (EIO).

Description of Related Arts

Metamaterial is an artificial subwavelength structure with extraordinary physical characteristics not possessed by natural materials, and these characteristics depend on the shape, geometric size, and arrangement of unit cells of the metamaterial, rather than the material itself. The generalized metamaterial includes the negative permittivity material, the negative permeability material, the left-handed material which is also called double negative material or negative refractive index material, the near-zero refractive index material, and ultra-high refractive index material and etc. In the present invention, the involved metamaterials refer specifically to left-handed materials. Since the left-handed material has singular characteristics different from conventional materials such as negative refractive index, inverse Cherenkov radiation and reverse Doppler effect, the left-handed material becomes one of the research hotspots in the fields of the current artificial electromagnetic material, microwave, optics, acoustics, and so on. The subwavelength structure of the left-handed material makes the vacuum electronic device based on the left-handed material capable of achieving miniaturization. At the same time, due to the strong resonant characteristics of the left-handed material, the slow-wave structure formed by the left-handed material has an extremely high axial electric field, thereby making the coupling impedance of the left-handed slow-wave structure much greater than the coupling impedance of the conventional slow-wave structure. These novel electromagnetic properties make left-handed materials have potential applications in the field of vacuum electronic devices. The paper "*All-metal metamaterial slow-wave structure for high-power sources with high efficiency*" (Y. Wang, Z. Duan, X Tang, et al., *Appl. Phys. Lett.,* 107(15), pp. 153502:1-5, 2015.) firstly proposed a left-handed material based on a Complementary electric Split-Ring Resonator (CeSRR). This left-handed material has the characteristics of strong resonance and miniaturization. Through simulation studies, it is found that the fundamental mode of the left-handed material has a strong axial electric field, and this left-handed material is expected to be suitable for vacuum electronic devices. For example, an S-band backward-wave oscillator designed with a filled CeSRR has a much larger electronic efficiency, which is about 45%, than a conventional backward-wave tube and a higher output power, about 4.5 MW, than a conventional backward-wave oscillator, and has the advantage of miniaturization. (Y. Wang, Z. Duan, F. Wang, et al., "*S-Band high-efficiency metamaterial microwave sources", IEEE Trans. Electron Dev.,* 63, pp. 3747-3752, 2016.)

Left-handed materials are used as a new type of electromagnetic medium, when charged particles enter from vacuum to the left-handed materials, the original space charge field must be changed. A new type of transition radiation will be generated at the interface between the vacuum and the left-handed materials. The research group from Saint-Petersburg State University of Russia conducted a theoretical study on this new type of transition radiation and theoretically derived the expression of the radiation field components. The study showed that this radiation has a radiation intensity greater than that of conventional transition radiation, and pointed out that the characteristics have potential applications in particle detection, accelerator, and the characterization of left-handed material parameters (S. N Galyamin, A. V. Tyukhtin, A. Kanareykin, et al., "*Reversed Cherenkov-transition radiation by a charge crossing a left-handed medium boundary", Phys. Rev. Lett.,* 103(19), pp. 194802:1-4, 2009.). However, the paper only theoretically predicts a brand-new transition radiation that is produced by charged particles passing through the interface between the conventional material and the left-handed material media, and the reverse Cherenkov radiation in the left-handed material. In addition, the related experimental work has not been reported. In the field of vacuum electronic devices, this new left-handed material-based transition radiation mechanism will facilitate the development of new left-handed materials EIK and EIO.

In summary, based on the development of conventional S-band klystrons, the S-band miniaturization and high efficiency EIK based on the transitional radiation mechanism of the left-handed material are primarily disclosed by the present invention. Of course, this method is also suitable for the study of miniaturized high efficiency EIO based on left-handed materials. Based on this radiation mechanism, new types of millimeter-wave and terahertz-wave left-handed materials EIK and EIO can be developed by reducing the size according to the principle of scale reduction. In the microwave frequency range, the left-handed material EIK has great application prospects in achieving high power, high efficiency and miniaturization, especially in industrial heating, medical accelerators and large scientific devices and other fields. The present invention has a wide range of applications in the millimeter wave, sub-millimeter wave and terahertz band. The left-handed materials EIK and EIO have a wide range of applications in satellite communications, cloud satellites and spaceborne radars.

SUMMARY OF THE PRESENT INVENTION

Based on a mechanism of transition radiation in the left-handed materials, the present invention provides a three-cavity EIK with a small size, a high gain and a high efficiency in the S-band. On this basis, the present invention discusses impacts on performances of the EIK by adding attenuating material between an input cavity and a middle cavity.

Technical solutions adopted by the present invention are as follows.

A left-handed material extended interaction klystron, comprises: an input cavity, a middle cavity, an output cavity, a first-section drift tube and a second-section drift tube; wherein the input cavity, the middle cavity and the output cavity are all cylindrical resonant cavities having arrays of Complementary electric Split-Ring Resonator (CeSRR) unit cells provided therein; wherein a first side of the input cavity is an input channel of an electron beam, a second side of the input cavity connects the middle cavity via the first-section drift tube; a first T-shaped coaxial input structure is provided in the input cavity; a first side of the output cavity is for connecting an electronic output terminal of an electron collector, a second side of the output cavity connects the middle cavity via the second-section drift tube; a second T-shaped coaxial output structure is provided in the output cavity.

Preferably, a layer of attenuator with uniform thickness is provided on an external side of the first-section drift tube, so as to reduce an amplitude of clutter signals of the modulated electronic signature.

Preferably, each array of adjacent CeSRR unit cells of the input cavity, the middle cavity and the output cavity has equal period.

Preferably, both the first-section drift tube and the second-section drift tube are circular waveguide structures having an equal internal diameter with a diameter of the electron injection channel.

Preferably, periods of the array of the CeSRR unit cells in the input cavity, the middle cavity, and the output cavity decrease in sequence.

Preferably, the input cavity, the middle cavity and the output cavity all have four CeSRR unit cells.

Preferably, the Complementary electric Split-Ring Resonator (CeSRR) unit cells comprise an external metal ring, two coupling gaps, an internal metal ring and two sections of metal bridge for connecting the internal metal ring and the external metal ring; wherein grooves are provided on a joint of the metal bridge and the internal metal ring; an electron beam channel is provided on a center of the internal metal ring and the first section internal drift tube is provided on an external side of the electron beam channel.

The resonant cavities of left-handed material EIK all comprise cylindrical resonant cavities filled with the CeSRR arrays. The CeSRR unit cell ensures that the input cavity, the middle cavity and the output cavity are all working in a specific frequency band. Internal drift tube is provided on an external side of the circular-shaped electron beam channel of the array to reduce a high frequency gap, i.e., the distance between adjacent CeSRR unit cells. In addition, the internal drift tube has effects of expanding bandwidth and enhancing axial electric field. Inputting signals by the T-shaped coaxial input structure is capable of facilitating regulating external quality factors of the input cavity, and meanwhile reducing a large volume caused by a waveguide of S band, so as to realize the miniaturization of the device in the lateral direction. Particle simulation software is utilized to optimize the first-section drift tube and the second-section drift tube, which makes the electron beam of the output cavity to reach an optimal value, thereby maximizing the electron efficiency. The period of the CeSRR unit cell in the output cavity is smaller than the period of the input cavity, so that the microwave energy can be better extracted to further improve the electronic efficiency. High-frequency gaps of the output cavity are unequally spaced and smaller than the length of high-frequency gaps of the input cavity. The method has advantage for improving the electronic efficiency and expanding the bandwidth. The output coupler and the input coupler have identical coaxial parameters, which are both standard SMA coaxial connector. The length and height of the T-shaped head of the output structure are selected by considering from the aspects of the efficiency, bandwidth and operating frequency. The metal material adopted in left-handed material EIK is oxygen-free copper, other good conductors such as aluminum, gold and stainless steel can also be adopted according to actual conditions in other preferred embodiments.

The left-handed material EIK of the present invention is working in S-band, wherein the specific operating frequency can be changed by adjusting the structural size of the left-handed materials. The operating frequency of the resonant cavity with left-handed material EIK is 2.457 GHz. When a voltage and a current of the electron beam are respectively 33.5 kV and 4 A, an axial focusing magnetic field is 0.15 T and a power of the input signal is 0.72 W, a peak output power of the amplified signal obtained is 102.3 kW and an average power is 51.15 kW, a gain is 48.5 dB and an electronic efficiency is 39%.

From this, it can be seen that the left-handed material EIK of the present invention has extremely apparent advantages in terms of high gain, miniaturization, and high efficiency, and therefore has potential applications in radar, industrial heating, and satellite communications.

These and other objectives, features, and advantages of the present invention will become apparent from the following detailed description, the accompanying drawings, and the appended claims.

BRIEF DESCRIPTION OF THE DRAWINGS

FIG. 1-*a* is a front view of a CeSRR; FIG. 1-*b* is a left view of the CeSRR; FIG. 1-*c* is a schematic structural view of an EIK input cavity; FIG. 1-*d* is an overall structural diagram of the Left-Handed Materials EIK.

REFERENCES OF THE DRAWINGS

Figure 2:
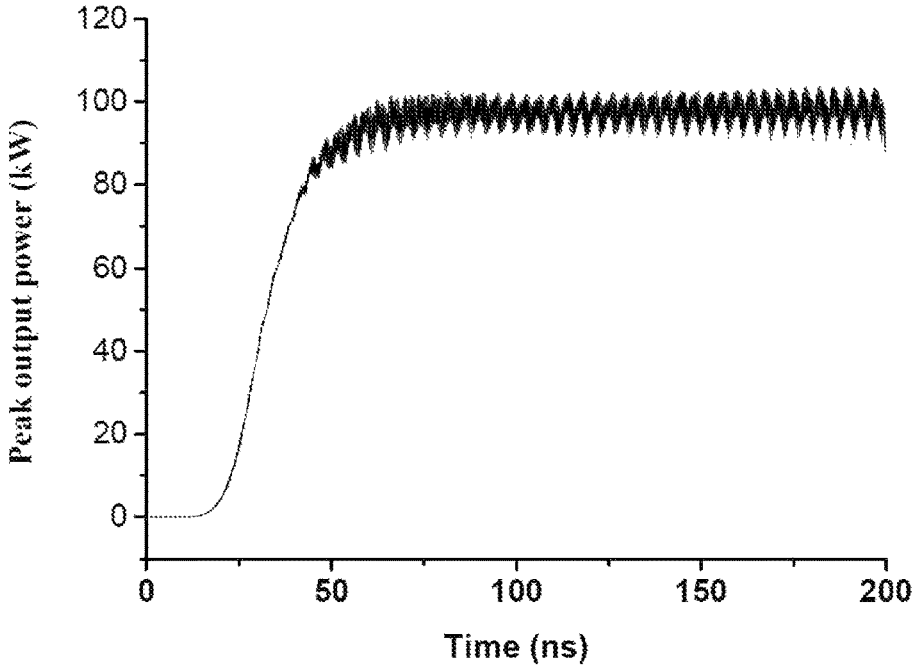
FIG. 2 is a peak output power diagram of an EIK amplified signal.

1—external metal ring; 2—coupling gap; 3—electron beam channel; 4—metal bridge; 5—groove; 6—internal drift tube; 7—internal metal ring; 8—T-type coaxial input structure; 9—input channel of an electron beam; 10—metal shell of the cylindrical resonant cavity; 11—attenuator; 12—first section drift tube; 13—second section drift tube; 14—T-type coaxial output structure; 15—electron beam output terminal; A—input cavity; B—middle cavity; C—output cavity.

DETAILED DESCRIPTION OF THE PREFERRED EMBODIMENT

Further description of the present invention is illustrated combining with the accompany drawings and the preferred embodiments.

Referring to FIG. 1-*a*, FIG. 1-*b*, FIG. 1-*c* and FIG. 1-*d*, wherein a size of the left-handed materials EIK is as follows. Inner diameters of three cylindrical resonant cavities are all 36 mm. A radius of the electron beam channel is 4 mm. A wall thickness of the cavities is 2 mm. A length of an input cavity A is 68.5 mm; a period of adjacent CeSRR is set as 20 mm; lengths of internal drift tubes are all 8.5 mm, a length of a T-shaped head is 11 mm; a distance of the T-shaped head to a central axis is 10 mm. An internal radius and an external radius of a coaxial input structure are respectively 0.5 mm and 3.5 mm. A length of a middle cavity B is 66.8 mm. A period length of an adjacent CeSRR in the middle cavity is 19.5 mm, wherein an internal drift tube thereof has a length of 8.3 mm. A length of an output cavity C is 63.8 mm. In the output cavity, a the length of a T-shape head is 12 mm, a distance of the T-shape head to a central axis is 9 mm, A period of an adjacent CeSRR in the output cavity is 18.5 mm and corresponded internal drift tubes are respectively 8.5 mm, 8.5 mm, 8.0 mm and 8.0 mm. A length of a first section drift tube is 45 mm and a length of a second section drift tube is 50 mm. A diameter of an external metal ring of the CeSRR is 36 mm; a width of the external metal ring is 2 mm; a diameter of an internal metal ring is 26 mm; a diameter of an electron beam channel is 8 mm; a width of a coupling gap is 3 mm; a width of a metal bridge is 2 mm; a width and a depth of grooves on double sides of a metal bridge are respectively 3 mm and 2 mm; thicknesses of both the CeSRR and internal drift tube are 1 mm. In addition, an external side of a first section drift tube is filled with an attenuating material of beryllium oxide (BeO) having a thickness of 3 mm; wherein the relative permittivity of the attenuating material is 6.5 and a loss angle tangent is 0.5. Thus, the high-frequency oscillation is suppressed and the electron beam entering into the middle cavity is easier for further modulation.

Figure 3:
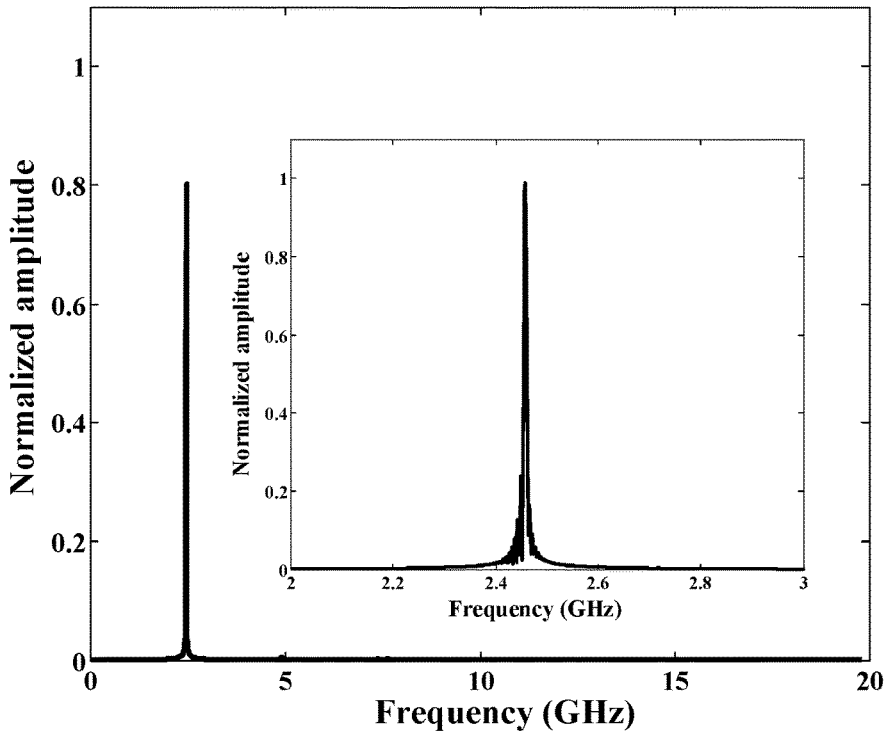
FIG. 3 is a spectrum diagram of an output signal of the EIK.
Figure 4:
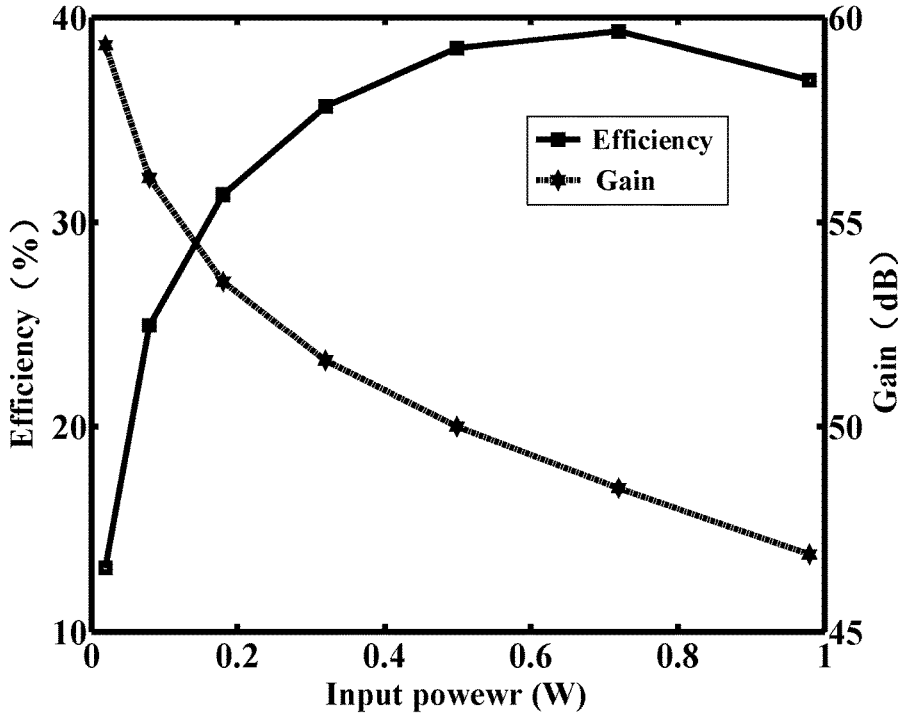
FIG. 4 is a diagram of gain and electronic efficiency of the output signal versus the input power of the EIK.
Figure 5:
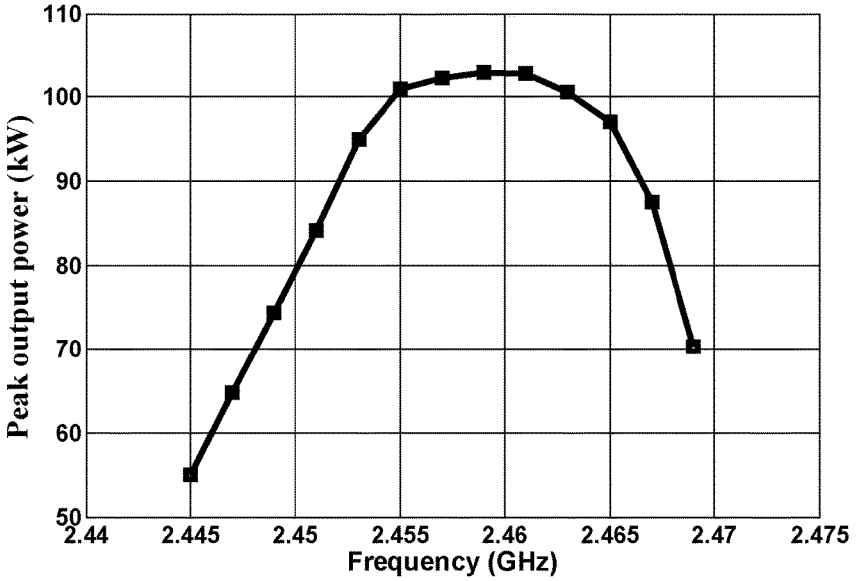
FIG. 5 is a diagram of peak output power versus the input signal of different frequency.
Figure 6:
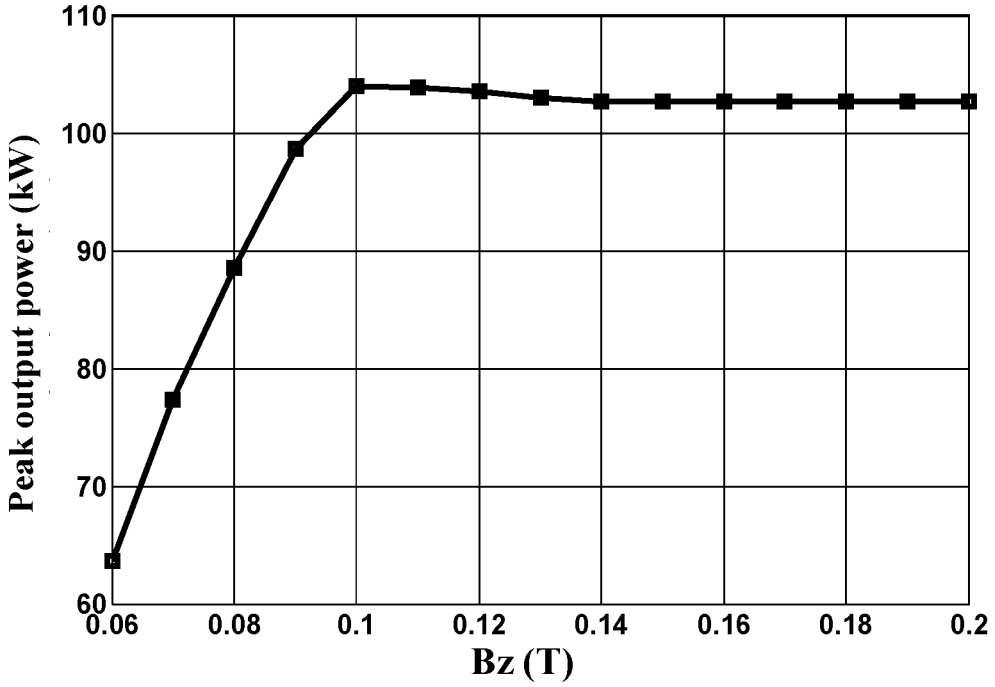
FIG. 6 is a peak output power diagram corresponding to different axial focusing magnetic field.

Based on the structure parameters mentioned above, for a three-cavity left-handed material EIK, when a voltage of the electron beam is 33.5 kV, a current of the electron beam is 4 A, a magnetic induction density of the focusing electron beam is 0.15 T. As shown in FIG. 2, when the input power is 0.72 W, a peak output power is 102.3 kW, and a corresponding average output power is 51.15 kW. The spectrum of the output signal is obtained using Fourier transform. As shown in FIG. 3, it can be seen that the spectrum is very pure and there is no clutter signal, and the operating frequency is 2.4574 GHz, which only has a small difference with a frequency of the input signal (2.457 GHz). This difference is come from the electron beam load. In addition, when a frequency of the input signal is fixed at 2.457 GHz, the electronic efficiency and gain corresponding to different input power is as shown in FIG. 4. The FIG. 4 shows that a maximum electronic efficiency of the three-cavity EIK is 39%, and a corresponding gain is 48.5 dB. Here, the input cavity is a three-gap extended interaction structure, in such a manner that the electron beam which enters the output cavity obtains a greater modulation current of the fundamental wave. Hence, the electronic efficiency is further improved. When the beam voltage and current are 33.5 kV and 4 A, respectively, the focusing magnetic field is 0.2 T, and the input power is 0.5 W, the simulation results show the peak output power as a function of the input signal frequency (FIG. 5). FIG. 6 shows the peak output power versus the axial focusing magnetic field. It can be seen that the left-handed material EIK can obtain a larger output power with a lower axial uniform magnetic field (0.1 T) relative to conventional klystrons.

In summary, the left-handed material EIK provided by the present invention based on the mechanism of the transition radiation in left-handed materials is a low-band EIK with a high gain, high efficiency and small size. The EIK is easy achieving and has excellent performances in a three-cavity structure. The left-handed material EIK can achieve high gain, high efficiency, and wide bandwidth by using multiple left-handed material extended interaction cavities. Thus, the four or even more left-handed material extended interaction cavities can further improve the performance of the proposed EIK. Meanwhile, adopting unequal period and unequal high-frequency gaps has the potential of further enhancing the electronic efficiency. The output power can be further enhanced by improving period. Thus, resonant cavity with multiple gaps has advantages in tuning bandwidth, increasing efficiency, and shortening the axial length. Based on the left-handed material, similar left-handed material extended interaction oscillator (EIO) can be further designed. The three-cavity or multiple-cavity left-handed material EIK has wide application prospects in radar, industrial heating and satellite communications. In addition, the present invention provides new design ideas for developing other vacuum electronic devices with small size and high performance in other frequency bands.

One skilled in the art will understand that the embodiment of the present invention as shown in the drawings and described above is exemplary only and not intended to be limiting.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A left-handed material extended interaction klystron, comprising: an input cavity, a middle cavity, an output cavity, a first-section drift tube and a second-section drift tube; wherein the input cavity, the middle cavity and the output cavity are all cylindrical resonant cavities having arrays of Complementary electric Split-Ring Resonator (CeSRR) unit cells provided therein; wherein a first side of the input cavity is an input channel of an electron beam, a second side of the input cavity connects the middle cavity via the first-section drift tube; a first T-shaped coaxial input structure is provided in the input cavity; a first side of the output cavity is for connecting an electronic output terminal of an electron collector, a second side of the output cavity connects the middle cavity via the second-section drift tube; a second T-shaped coaxial output structure is provided in the output cavity.

2. The left-handed material extended interaction klystron, as recited in claim 1, wherein a layer of attenuator with uniform thickness is provided on an external side of the first-section drift tube.

3. The left-handed material extended interaction klystron, as recited in claim 1, each array of adjacent CeSRR unit cells of the input cavity, the middle cavity and the output cavity has equal period.

4. The left-handed material extended interaction klystron, as recited in claim 1, wherein period of the arrays of the CeSRR unit cells in the input cavity, the middle cavity and the output cavity are reduced in sequence.

5. The left-handed material extended interaction klystron, as recited in claim 3, wherein period of the arrays of the CeSRR unit cells in the input cavity, the middle cavity and the output cavity are reduced in sequence.

6. The left-handed material extended interaction klystron, as recited in claim 1, wherein the input cavity, the middle cavity and the output cavity all have four CeSRR unit cells.

7. The left-handed material extended interaction klystron, as recited in claim 3, wherein the input cavity, the middle cavity and the output cavity all have four CeSRR unit cells.

8. The left-handed material extended interaction klystron, as recited in claim 1, wherein the CeSRR unit cells comprise an external metal ring, two coupling gaps, an internal metal ring and two sections of metal bridge for connecting the internal metal ring and the external metal ring; wherein grooves are provided on a joint of the metal bridge and the internal metal ring; a center of the internal metal ring has an electron beam channel and the first section internal drift tube is provided on an external side of the electron beam channel.

9. The left-handed material extended interaction klystron, as recited in claim 8, both the first-section drift tube and the second-section drift tube a circular waveguide structure, wherein an internal radius of the drift tube structure is equal to a radius of the electron beam channel.

* * * * *